US012484672B2

(12) United States Patent
Li

(10) Patent No.: US 12,484,672 B2
(45) Date of Patent: Dec. 2, 2025

(54) MECHANICAL WALLET

(71) Applicant: Xue Du, Xuzhou (CN)

(72) Inventor: Risheng Li, Guiping (CN)

(73) Assignee: Xue Du, Xuzhou (CN)

( * ) Notice: Subject to any disclaimer, the term of this patent is extended or adjusted under 35 U.S.C. 154(b) by 129 days.

(21) Appl. No.: 18/535,912

(22) Filed: Dec. 11, 2023

(65) Prior Publication Data

US 2025/0169581 A1 May 29, 2025

(30) Foreign Application Priority Data

Nov. 27, 2023 (CN) ..... 202323230365.7

(51) Int. Cl.
*A45C 1/06* (2006.01)

(52) U.S. Cl.
CPC ..... *A45C 1/06* (2013.01); *A45C 2001/062* (2013.01); *A45C 2001/065* (2013.01); *A45C 2001/067* (2013.01)

(58) Field of Classification Search
CPC ..... A45C 1/06; A45C 2001/062; A45C 2001/065; A45C 2001/067; A45C 11/182
USPC ..... 150/147
See application file for complete search history.

(56) References Cited

U.S. PATENT DOCUMENTS

| | | | | |
|---|---|---|---|---|
| 4,887,739 | A * | 12/1989 | Parker | B65D 83/12 221/244 |
| 9,339,094 | B2 * | 5/2016 | Tucker-Skow | A45C 11/182 |
| 9,545,141 | B2 * | 1/2017 | Hsieh | A45C 13/00 |
| 10,653,222 | B2 * | 5/2020 | Scharnigg | B65D 83/08 |
| 10,667,588 | B2 * | 6/2020 | Chan | A45C 11/18 |
| 10,893,731 | B2 * | 1/2021 | Wingerter | B42F 17/32 |
| 2007/0045148 | A1 * | 3/2007 | Saclier | B65D 75/5805 206/499 |
| 2018/0140066 | A1 * | 5/2018 | Talarico | A45C 11/182 |
| 2018/0368547 | A1 * | 12/2018 | Grannan | A45C 11/182 |
| 2020/0305564 | A1 * | 10/2020 | Myers | A45C 1/06 |
| 2021/0251354 | A1 * | 8/2021 | Campain | A45C 11/182 |
| 2022/0248822 | A1 * | 8/2022 | Goodwin | A45C 13/185 |

* cited by examiner

*Primary Examiner* — Don M Anderson
*Assistant Examiner* — Justin Caudill
(74) *Attorney, Agent, or Firm* — JEEN IP LAW, LLC

(57) ABSTRACT

The present disclosure discloses a mechanical wallet or a card holder, which includes a sliding platform panel, a sliding groove bottom plate, a top cover, and a step rod. The sliding platform panel and the sliding groove bottom plate form a pair of sliding rails that can move up and down. The step rod is provided in the sliding platform panel and the sliding groove bottom plate and can rotate. The top cover is provided on the sliding rails composed by the sliding platform panel and the sliding groove bottom plate and can rotate relative to the sliding groove bottom plate by a cylinder of the top cover. The cylinder of the top cover is provided with a spring; the sliding groove bottom plate is further provided with a headless screw, which runs through the sliding groove bottom plate and abuts against the top cover.

14 Claims, 5 Drawing Sheets

MECHANICAL WALLET

CROSS-REFERENCE TO RELATED APPLICATIONS

This application claims priority to Chinese Patent Application No. 202323230365.7, filed on Nov. 27, 2023, which is hereby incorporated by reference in its entirety.

TECHNICAL FIELD

The present disclosure relates to the field of devices for storing cards (such as credit cards, driver's licenses, health insurance cards, government licenses, business cards, and other useful identification documents), and in particular, to a card holder of a mechanical card storage device. The mechanical card storage device stores cards in a step manner and restores an original position according to a weight of the cards, and automatically switches a top cover to prevent the card from falling.

BACKGROUND

Most people carry many standard size cards with them every day, such as credit cards, driver's licenses, health insurance cards, government licenses, business cards, and other useful identification documents. For ease of carrying, people place cards in their card holders and remove them when using them. However, most of the existing card holders consist of an aluminum shell, complex injection molded parts, and silicone resistance to prevent the card from falling. Over time, complex injection molded parts and silicone can age, making it difficult for wallets to store or display cards, causing cards to fall off, and so on. In addition, it requires two hands to push the card back to the cardholder. The cardholder cannot automatically open or close them, and manual operation is necessary to open or close them, which increases the complexity of the operation and affects the user's enthusiasm for use.

Therefore, it is necessary to provide a mechanical card holder that its top cover can automatically open or close to improve the aforementioned technical defects.

SUMMARY

To address the issues raised in the background technology mentioned above, the present disclosure provides a mechanical wallet with the characteristics of simple structure, automatic opening/closing of the top cover, and one hand operation by the user.

To achieve the above objectives, the present disclosure provides a mechanical card holder, a mechanical wallet or a card holder, which includes a sliding platform panel, a sliding groove bottom plate, a top cover, and a step rod. The sliding platform panel and the sliding groove bottom plate form a pair of sliding rails that can move up and down, and the step rod is provided in the sliding platform panel and the sliding groove bottom plate and can rotate. The top cover is provided on the sliding rail composed of the sliding platform panel and the sliding groove bottom plate and rotate relative to the sliding groove bottom plate by a cylinder of the top cover; the cylinder of the top cover is provided with a spring, and the sliding groove bottom plate is further provided with a headless screw that runs through the sliding groove bottom plate and abuts against the top cover; when the top cover is perpendicular to the sliding platform panel, the sliding platform panel is moved downwards, the top cover is driven to rotate clockwise relative to the sliding platform panel until the top cover is parallel to the sliding platform panel, the sliding platform panel is continue to move downwards, the step rod is driven to rotate clockwise relative to the sliding platform panel, and cards on the step rod are pushed out by the step rod one by one.

In an implementation mode of the present disclosure, the sliding groove bottom plate is provided with a sliding groove, and the sliding platform panel forms the pair of sliding rails moving up and down along the sliding groove bottom plate.

In an implementation mode of the present disclosure, the sliding platform panel is provided with a sliding platform that moves up and down along the sliding groove bottom plate.

In an implementation mode of the present disclosure, there is a gap between the sliding platform panel and a lower end of the sliding groove bottom plate.

In an implementation mode of the present disclosure, the sliding groove bottom plate is further provided with a cylinder, and the sliding platform panel is provided with a locking groove; the top cover is clamped with the sliding groove bottom plate when a first positioning column is placed in the locking groove.

In an implementation mode of the present disclosure, the first positioning column is provided with a resistance spring thimble locking mechanism.

In an implementation mode of the present disclosure, the resistance spring thimble locking mechanism is in a shape of spherical.

In an implementation mode of the present disclosure, the top cover is U-shaped.

In an implementation mode of the present disclosure, the sliding groove bottom plate is further provided with a cylinder, and the step rod rotates relative to a box body through the cylinder.

In an implementation mode of the present disclosure, a step is provided on the step rod, and the step rod is sleeved on a cylinder of the sliding groove bottom plate.

In an implementation mode of the present disclosure, the step rod is provided with at least one step.

In an implementation mode of the present disclosure, the mechanical wallet further includes a wallet, the wallet is detachably connected to the sliding groove bottom plate.

In an implementation mode of the present disclosure, the wallet is connected to the sliding groove bottom plate through a screw.

In an implementation mode of the present disclosure, the sliding platform panel, sliding groove bottom plate, and top cover are made of metal.

Compared with the prior art, the beneficial effects of the present disclosure are:

1. the present disclosure first arranges a spring on a right cylinder connected to the top cover and the sliding groove bottom plate to assist in rotating the top cover, so that the sliding groove bottom plate can be automatically opened or closed, achieving the technical purpose of using the card holder with one hand;
2. at the same time, a sliding platform panel is provided with a resistance spring thimble locking mechanism to prevent the sliding platform panel from being accidentally moved, ensuring the safety and convenience of use when in a closed position.

BRIEF DESCRIPTION OF DRAWINGS

In order to provide a clearer explanation of the technical solution of the embodiments of the present disclosure, a brief introduction will be given to the drawings required for the description of the embodiments. It is obvious that the drawings in the following description are only some embodiments of the present disclosure. For ordinary technical personnel in the art, other drawings can be obtained based on these drawings without any creative work.

Figure 1:
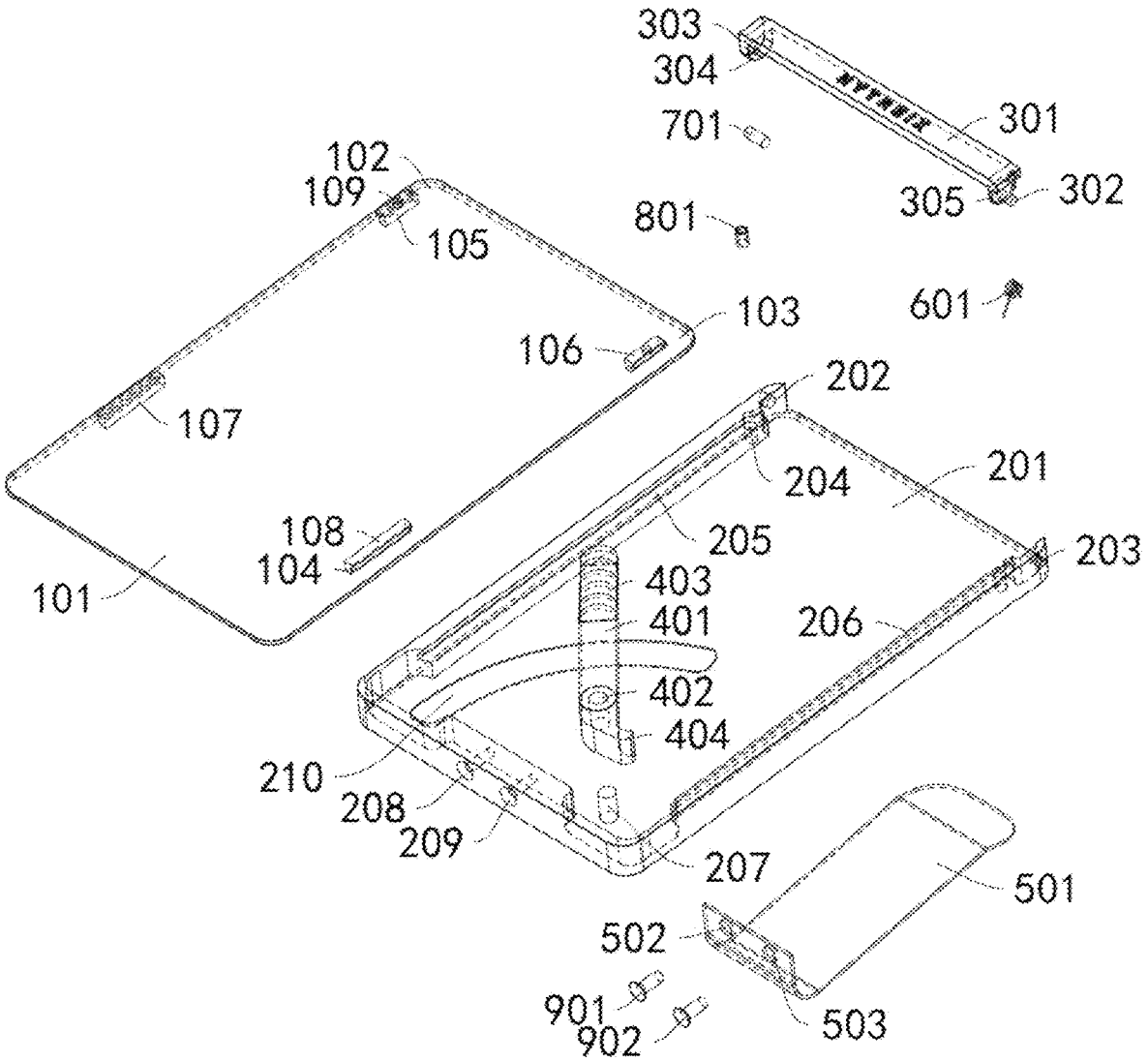
FIG. 1 is an exploded structural view of a mechanical wallet of the present disclosure.
Figure 2:
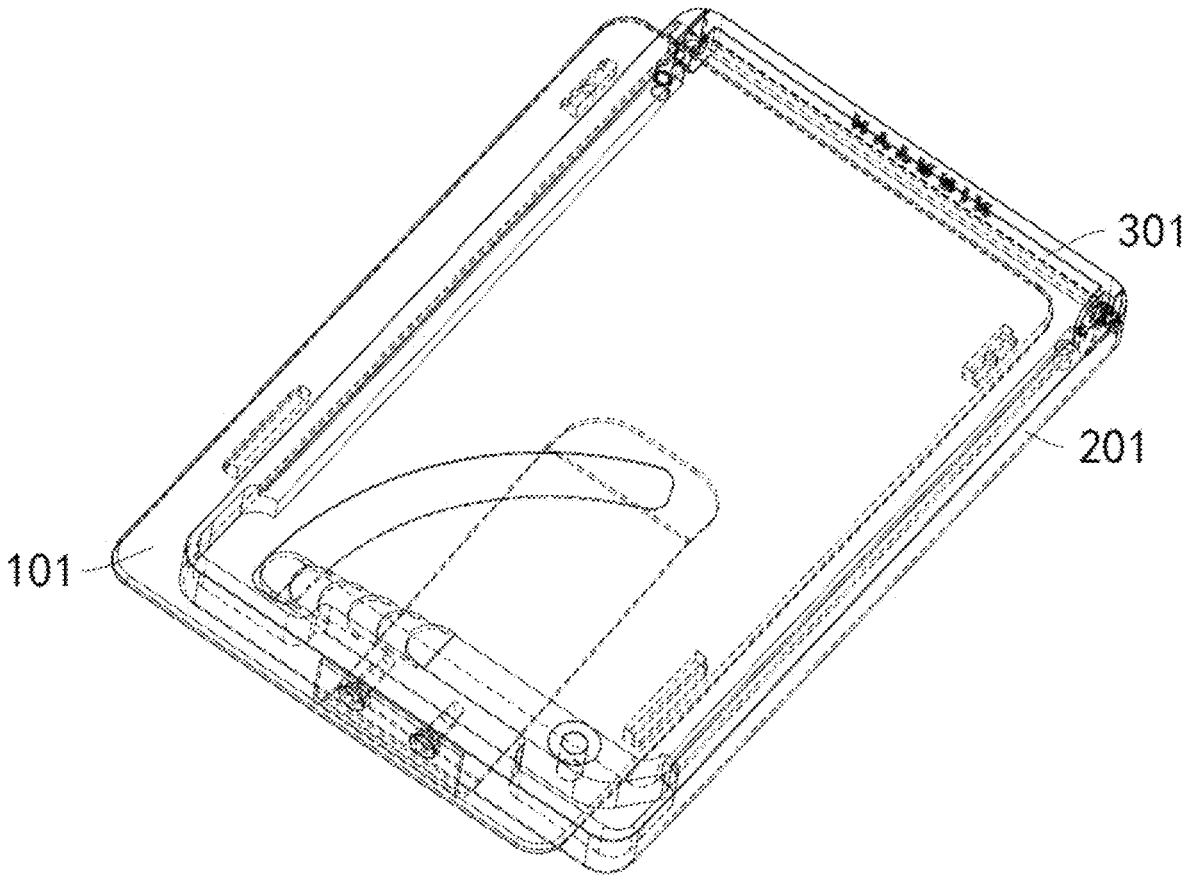
FIG. 2 is a structural schematic diagram of an assembly structure of a sliding platform panel 101, sliding groove bottom plate 201, and top cover 301 of the mechanical wallet of the present disclosure.

Numeral reference: 101—sliding platform panel, 102—upper left corner plane, 103—upper right corner plane; 104—lowere end of a lower right sliding platform, 105—upper left sliding, 106—upper right sliding platform, 107—lower left sliding platform, 108—lower right sliding platform, 109—upper left sliding platform hole; 201—sliding groove bottom plate, 202—upper left circular hole, 203—upper right circular hole, 204—resistance spring thimble installation hole, 205—left sliding groove; 206—right sliding groove, 207—cylinder, 208—lower left screw hole, 209—lower right hole, 210—anti pinch slot; 301—top cover, 302—right cylinder, 303—left screw hole, 304—left switch position, 305—right switch position; 401—step rod, 402—circular hole, 403—step rod lever for cards, 404—lever end; 501—money clip, 502—left hole, 503—right hole; 601—spring; 701—headless screw; 801—resistance marble; 901—left screw; 902—right screw.

DESCRIPTION OF EMBODIMENTS

The following will provide a clear and complete description of the technical solution in the embodiments of the present disclosure, in combination with the drawings. Obviously, the described embodiments are only a part of the embodiments of the present disclosure, not all of them. Based on the embodiments in the present disclosure, all other embodiments obtained by ordinary technicians in the art without creative work fall within the protection scope of the present disclosure.

Please refer to FIGS. 1 to 5, a mechanical wallet or a card holder, which includes a sliding platform panel 101, a sliding groove bottom plate 201, a top cover 301, a step rod 401, and a money clip 501. The sliding platform panel 101 and the sliding groove bottom plate 201 are assembled to form a pair of sliding rails that can move up and down. The sliding platform panel 101 moves down, the top cover 301 automatically opens and forms a space that can accommodate multiple cards, the space can receive multiple cards (as described in the present description, a card refers to a credit card, license, health insurance card, or any other standard size card), and then the sliding platform panel 101 is moved downwards, the step rod 401 rotates the cards to arrange them in a step manner. The sliding platform panel 101 moves upwards, the cards automatically return to an original position, and then the sliding platform panel 101 moves upwards and the top cover 301 is closed. The money clip 501 is integrated or detachable by installing a left screw 901 and a right screw 902 through a left screw hole 502 and a right screw hole 503, as well as a lower left screw hole 208 and a lower right screw hole 209 at a bottom of the sliding groove bottom plate 201.

The sliding platform panel 101 forms the pair of sliding rails with corresponding left sliding groove 205 and right sliding groove 206 of the sliding groove bottom plate 201 through upper left sliding platform 105, upper right platform panel 106, lower left sliding platform 107, and lower right sliding platform 108. A space formed between the sliding platform panel 101 and the sliding groove bottom plate 201 is used to receive multiple cards.

Where, the top cover 301 is assembled with a spring 601 in the middle of the top cover 301 through a right cylinder 302, and M2 headless screw 701 is assembled on the sliding groove bottom plate 201 through an upper left circular hole 202. After installation, the top cover 301, the sliding platform panel 101, and the sliding groove bottom plate 201 form the sliding rail that are adapted when be opened or closed. Upper left corner plane 102 and upper right corner plane 103 of the sliding platform panel 101 are moved downwards, the left switch position 304 and right switch position 305 are not linked, the spring 601 is in a working state, and the top cover 301 is automatically opened. The sliding platform panel 101, upper left corner plane 102, and upper right corner plane 103 are moved upwards, left switch position 304 and right switch position 305 are linked, and the spring 601 does not work; and thus, the top cover 301 is automatically closed.

Where, the step rod 401 is centered around an axis of the cylinder 207 and is mounted at a space below the sliding platform panel 101 and the sliding groove bottom plate 201 through a link between the circular hole and the cylinder. The upper left corner plane 102 and upper right corner plane 103 of the sliding platform panel 101 are moved downwards. At this time, the left switch position 304 and right switch position 305 are not linked, and the spring 601 is working, the top cover 301 is automatically opened to receive multiple cards, the lower right sliding platform of the sliding platform panel 101 is moved downwards and pushes the top of the step rod 401 to rotate by about 55 degrees, multiple cards are arranged in a step manner from an opening position of the top cover 301. The sliding platform panel 101 is moved upwards and the lower right sliding platform 105 is not linked, the top of the step rod 401 rotates to an original position, and multiple cards are overlapped and return to an original position from the opening position of the top cover 301. Then the top cover 301 is moved upwards to automatically close and complete the work.

Where, the money clip 501 is fixed to a lower left screw hole 208 through a left screw 901, a right screw 902, a left hole 502, and a right hole 503; and a lower right hole 209 is installed below the sliding groove bottom plate 201, which can be combined or detachable. The money clip 501 is made of elastic steel material and can elasticity hold folded cash and bills.

Where, the spring 601 is a torsion spring installed in a middle of a right cylinder 302. The sliding platform panel 101 is moved downward, the upper left corner plane 102, and the upper right corner plane 103 do not link the left switch position 304 and the right switch position 305, the spring 601 works, and top cover 301 is automatically opened. The sliding platform panel 101 is moved upward, upper left corner plane 102 and upper right corner plane 103 link the left switch position 304 and the right switch position 305, the spring 601 does not work and the top cover 301 is automatically closed.

Where, the headless screw 701 is assembled with the top cover 301 through the left screw hole 303 and the left top circular hole 202. The headless screw 701 and the right cylinder 302 form a pair of rotating shafts to fix on the sliding groove bottom plate 201.

Where, the resistance spring thimble 801 is composed of steel balls, pressure springs, and a stainless-steel shell. The resistance spring thimble 801 is installed in a resistance spring thimble installation hole 204. The sliding platform panel 101 is moved downwards, steel ball on the resistance spring thimble 801 has a half circle in the upper left sliding platform hole 109, the upper left corner plane 102 and the upper right corner plane 103 do not link the left switch position 304 and the right switch position 305, the resistance spring thimble 801 works to increase resistance and reduces an accidental opening of the top cover, ensuring the safety and convenience of card box during use.

Where, the step rods 401 are assembled on the sliding platform panel 101 and the bottom 201 of the sliding groove bottom plate, and the step rods 401 can rotate relative to the sliding groove bottom plate.

Where, the top cover 301 is assembled on the top of the sliding platform panel 101 and the sliding groove bottom plate 201 and can rotate relative to the sliding groove bottom plate.

Figure 3:
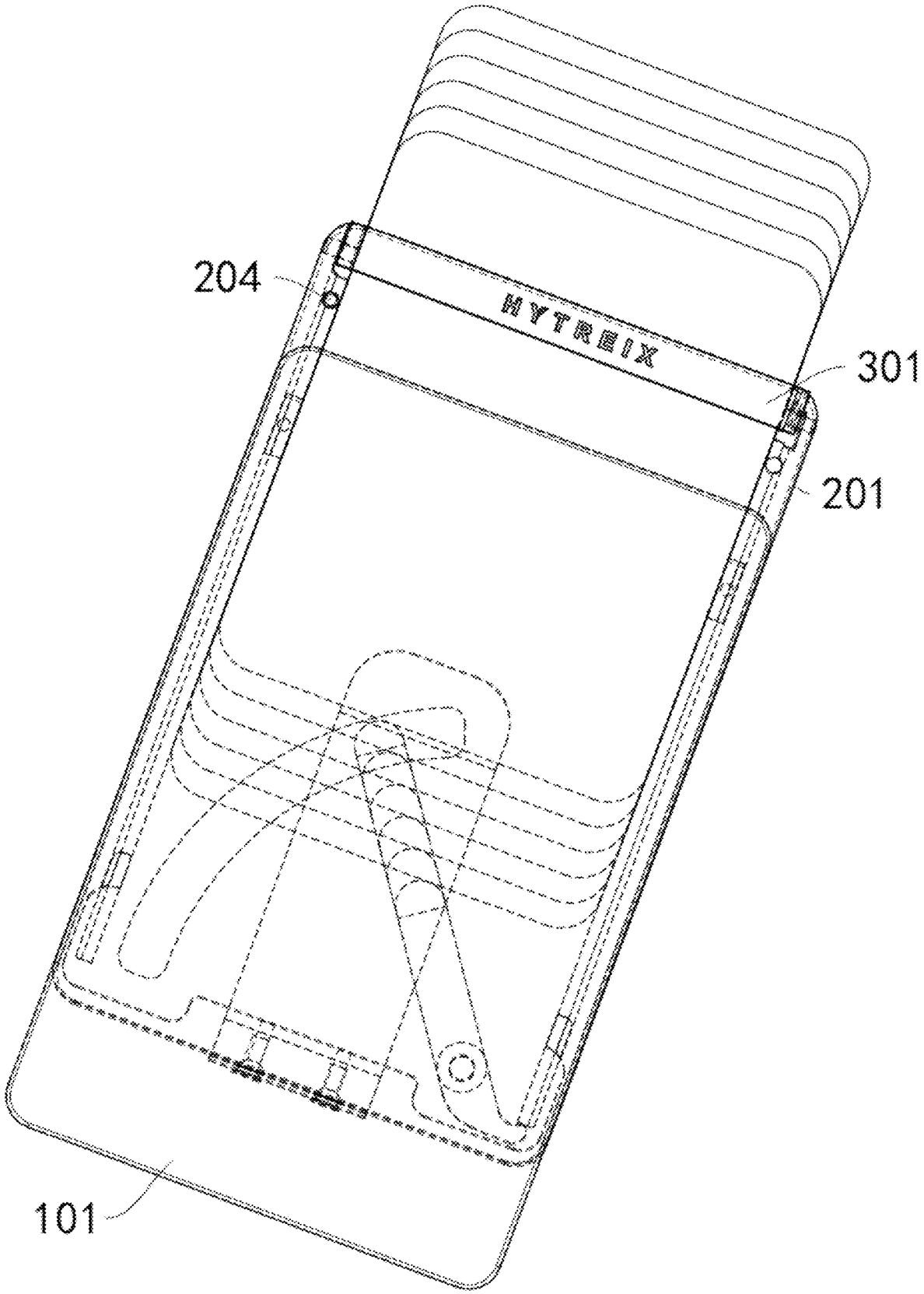
FIG. 3 is a state diagram of the sliding platform panel 101 of the mechanical wallet of the present disclosure driving a card on a step rod 401 to be pushed out of the top cover 301 for display or use.
Figure 4:
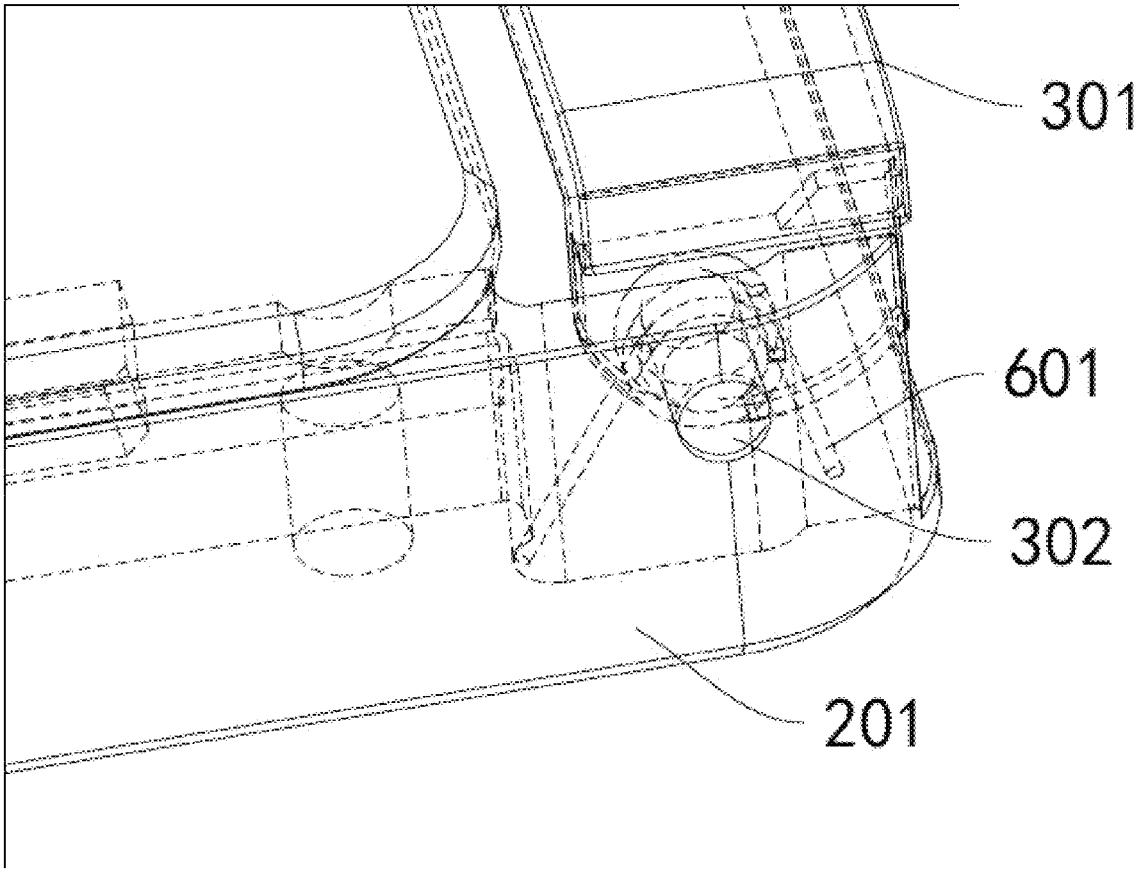
FIGS. 4 and 5 are perspective schematic diagrams of a resistance spring thimble 801 locking mechanism of the mechanical wallet of the present disclosure.
Figure 5:
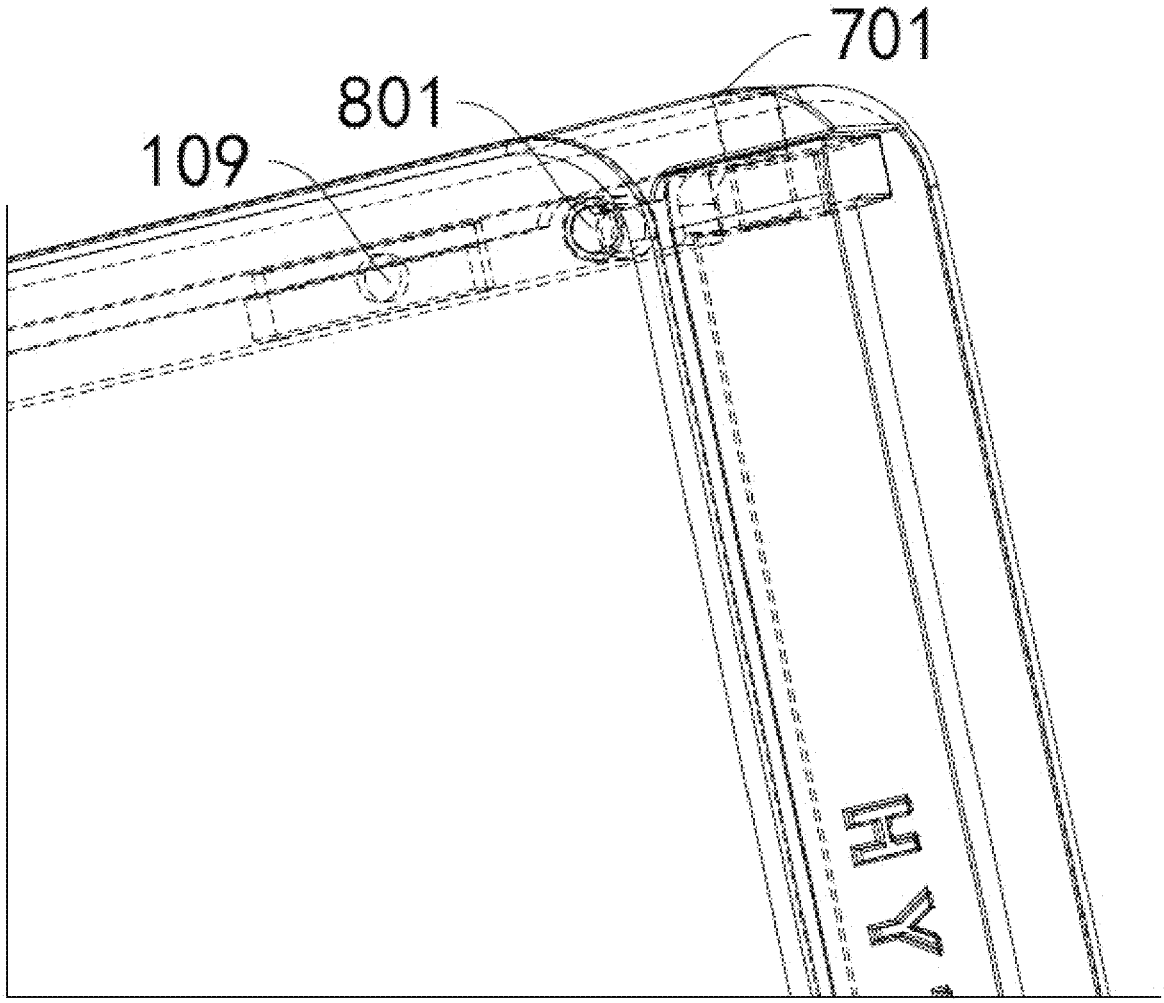

When the top cover 301 is located at a position perpendicular to the sliding platform panel 101 (a position as shown in FIG. 3), the sliding groove bottom plate 201 is in the closed position. At this time, cards on the step rod 401 are placed in the space composed of the sliding platform panel 101 and the sliding groove bottom plate 201; when the top cover 301 is located at a position being parallel to the sliding platform panel 101, the sliding groove bottom plate 201 is in the open position. At this time, a user can move the sliding platform panel 101 to drive the cards on the step rod 401 to be pushed out of the space composed of the sliding platform panel 101 and the sliding groove bottom plate 201 in a step manner by the step rod 401 for display or use.

Where, when the top cover 301 is perpendicular to the sliding platform panel 101, the top cover 301 is also perpendicular to the sliding groove bottom plate 201, the sliding groove bottom plate 201 is in the closed position, and cards on the step rod 401 are placed in the space composed of the sliding platform panel 101 and the sliding groove bottom plate 201. At this time, the cylinder of the top cover 301 contacts the spring 601 and the sliding platform panel 101 is sliding downwards. The upper left corner plane 102 and the upper right corner plane 103 on the sliding platform panel 101 also move downwards synchronously, when moving downwards, the spring 601 is pushed clockwise, which generates an elastic force and drives the top cover 301 to rotate clockwise relative to the sliding groove bottom plate 201; when an rotation angle of the top cover 301 reaches 90°, the top cover 301 is parallel to the sliding platform panel 101. At this time, the space composed of the sliding platform panel 101 and the sliding groove bottom plate 201 is in the open position. Then, the sliding platform panel 101 is continuing to slide downwards until the lower right sliding platform 108 abuts against a top of a lever rod 404, and the sliding platform panel 101 is continuing to slide downwards. The lower right sliding platform 108 will drive the step rod 401 to rotate clockwise relative to the sliding groove bottom plate 201, cards on the step rod 401 are gradually arranged in steps and pushed out of the space composed of the sliding platform panel 101 and the sliding groove bottom plate 201. When the top of the lever rod 404 abuts against a side wall of a lower of the sliding groove bottom plate 201, the step rod 401 cannot continue to rotate clockwise, and the sliding platform panel 101 cannot continue to move downwards. At this time, cards on the step rod 401 can be displayed or taken out.

The beneficial effects of the present disclosure are:

1. the present disclosure first arranged a spring 601 on the right cylinder 302 connected to the top cover 301 and the sliding groove bottom plate 201 to assist in rotating the top cover 301, so that the space composed of the sliding platform plate 101 and the sliding groove bottom plate 201 can be automatically opened or closed, achieving the technical purpose of using the card holder with one hand;
2. at the same time, the sliding platform panel 101 is provided with a resistance spring thimble 801 locking mechanism, which prevents accidental movement of sliding platform panel 101. This ensures that the space composed of sliding platform panel 101 and sliding groove bottom plate 201 is in the closed position and will not be accidentally opened, ensuring the safety and convenience of card package use.

Although embodiments of the present disclosure have been shown and described, it can be understood by ordinary technical personnel in the art that multiple changes, modifications, substitutions, and variations can be made to these embodiments without departing from the principles and spirit of the present disclosure. The scope of the present disclosure is limited by the accompanying claims and their equivalents.

In the description of the present specification, reference terms "one embodiment", "another embodiment", "example", etc. refer to the specific features, structures, materials, or features described in combination with the embodiment or example being included in at least one embodiment or example of the present disclosure. In the present specification, the schematic expressions of the above terms do not necessarily refer to the same embodiments or examples.

The further embodiments of the present disclosure disclosed above are only intended to assist in elucidating the present disclosure. Further embodiments do not fully describe all details, nor do they limit the present disclosure to the specific embodiments described. Obviously, there are many modifications and changes that can be made based on the content of the present description. The present specification selects and specifically describes these embodiments in order to better explain the principles and practical applications of the present disclosure, so that those skilled in the art can better understand and utilize the present disclosure.

What is claimed is:

1. A mechanical wallet, comprising a sliding platform panel, a sliding groove bottom plate, a top cover, and a step rod, wherein the sliding platform panel and the sliding groove bottom plate form a pair of sliding rails that move up and down, the step rod is provided in the sliding platform panel and the sliding groove bottom plate and rotates relative to the sliding groove bottom plate, the top cover is provided on the sliding rail and rotates relative to the sliding groove bottom plate by a cylinder of the top cover, the cylinder of the top cover is provided with a spring; the sliding groove bottom plate is further provided with a headless screw that runs through the sliding groove bottom plate and abuts against the top cover;

when the top cover is perpendicular to the sliding groove bottom plate, the sliding groove bottom plate is moved downwards, the top cover is driven to rotate clockwise relative to the sliding platform panel until the top cover is parallel to the sliding platform panel, the sliding platform panel continues to move downwards, the step rod is driven to rotate clockwise relative to the sliding platform panel, and cards on the step rod are pushed out by the step rod one card after another.

2. The mechanical wallet according to claim 1, wherein the sliding groove bottom plate is provided with a sliding groove, and the sliding platform panel forms the pair of sliding rails moving up and down along the sliding groove bottom plate.

3. The mechanical wallet according to claim 1, wherein the sliding platform panel is provided with a sliding platform that moves up and down along the sliding groove bottom plate.

4. The mechanical wallet according to claim 1, wherein there is a gap between the sliding platform panel and a lower end of the sliding groove bottom plate.

5. The mechanical wallet according to claim 1, wherein the sliding groove bottom plate is further provided with a cylinder, and the sliding platform panel is provided with a locking groove; the top cover is clamped with the sliding groove bottom plate when a first positioning column is placed in the locking groove.

6. The mechanical wallet according to claim 5, wherein the first positioning column is provided with a resistance spring thimble locking mechanism.

7. The mechanical wallet according to claim 6, wherein the resistance spring thimble locking mechanism is in a shape of spherical.

8. The mechanical wallet according to claim 1, wherein the top cover is U-shaped.

9. The mechanical wallet according to claim 1, wherein the sliding groove bottom plate is provided with a cylinder, and the step rod rotates relative to a box body through the cylinder.

10. The mechanical wallet according to claim 1, wherein a step is provided on the step rod, and the step rod is sleeved on a cylinder of the sliding groove bottom plate.

11. The mechanical wallet according to claim 1, wherein the step rod is provided with at least one step.

12. The mechanical wallet according to claim 1, further comprising a wallet, the wallet is detachably connected to the sliding groove bottom plate.

13. The mechanical wallet according to claim 12, wherein the wallet is connected to the sliding groove bottom plate through the headless screw.

14. The mechanical wallet according to claim 1, wherein the sliding platform panel, sliding groove bottom plate, and top cover are made of metal.

* * * * *